United States Patent [19]

Sanbayashi et al.

[11] Patent Number: 4,551,813

[45] Date of Patent: Nov. 5, 1985

[54] JAM DETECTOR

[75] Inventors: Takeshi Sanbayashi; Hiroshi Matsumoto, both of Yokohama, Japan

[73] Assignee: Tokyo Shibaura Denki Kabushiki Kaisha, Kawasaki, Japan

[21] Appl. No.: 439,985

[22] Filed: Nov. 8, 1982

[30] Foreign Application Priority Data

Nov. 30, 1981 [JP] Japan ..... 56-192018

[51] Int. Cl.[4] ..... B65H 7/02

[52] U.S. Cl. ..... 364/569; 271/258; 355/14 R

[58] Field of Search ..... 271/258, 259; 355/14 R, 355/14 TR; 364/569; 377/16, 52

[56] References Cited

U.S. PATENT DOCUMENTS

| | | | |
|---|---|---|---|
| 4,084,900 | 4/1978 | Yamaoka et al. | 271/258 X |
| 4,247,193 | 1/1981 | Kaneko et al. | 355/14 R |
| 4,275,879 | 6/1981 | Yamashita et al. | 271/258 X |
| 4,307,957 | 12/1981 | Kitagawa et al. | 271/258 X |

FOREIGN PATENT DOCUMENTS 55-2622 1/1980 Japan .

56-149933 11/1981 Japan .

*Primary Examiner*—Errol A. Krass
*Assistant Examiner*—Edward R. Cosimano
*Attorney, Agent, or Firm*—Cushman, Darby & Cushman

[57] ABSTRACT

A jam detector comprising a timer, a comparator for comparing time interval data preset in the timer with time interval data which indicates the time interval required for conveying a transfer paper sheet from a first position to a second position, an operation control device for computing updated time interval data to be reset in the timer, and a RAM for storing the computed data. When a plurality of transfer paper sheets are present along the conveyance path extending from the first position to the second position, the conveying time interval data of the first transfer paper sheet is set in the timer. When the first transfer paper sheet reaches the second position, conveying time for the second transfer paper sheet to reach from the first position to the current position is computed by utilizing the data preset in the timer. The conveying time for the second transfer paper sheet to reach from the current position to the second position is computed, and is reset in the timer. This process is repeated for each succeeding transfer paper sheet.

4 Claims, 19 Drawing Figures

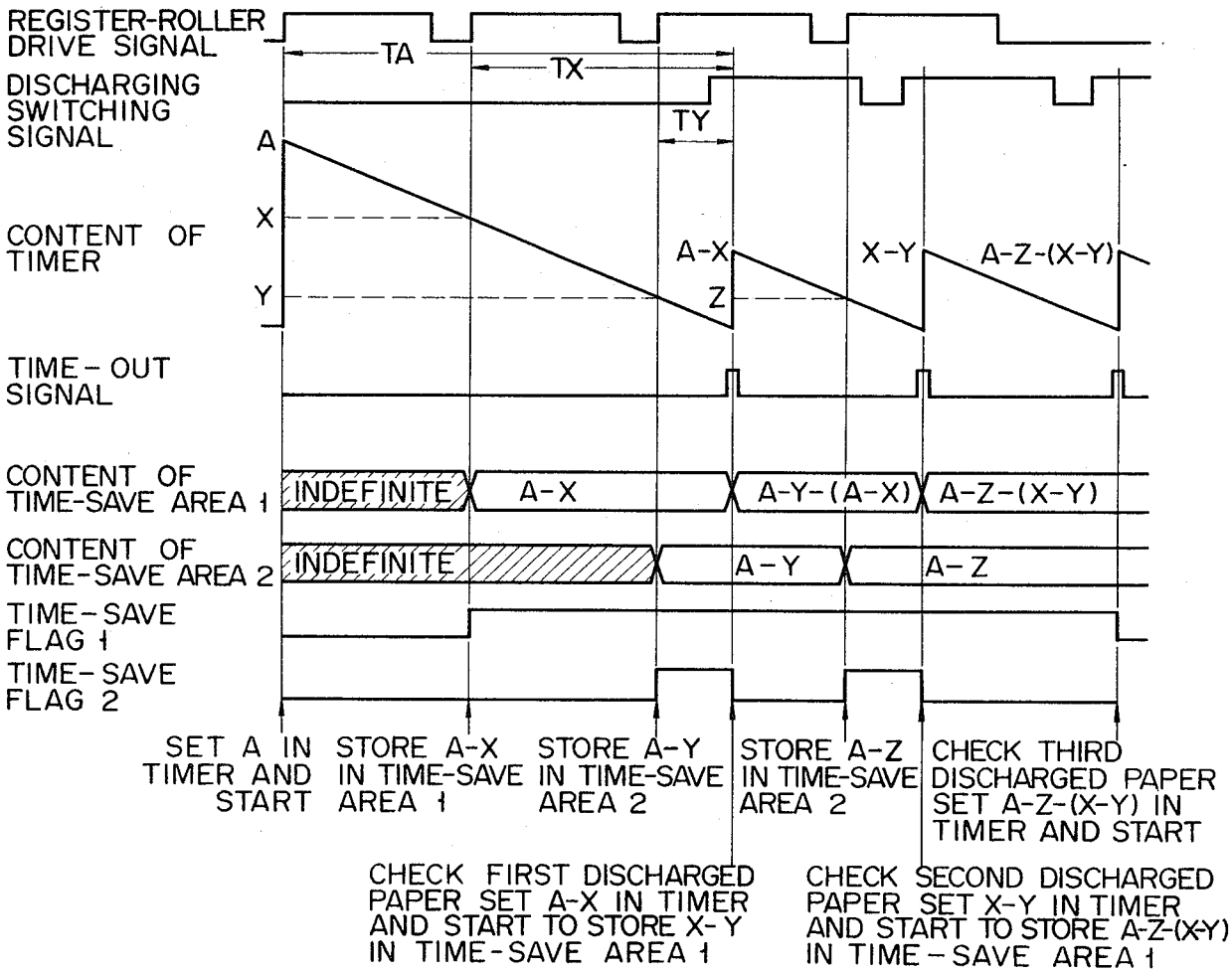
FIG. 5A REGISTER-ROLLER DRIVE SIGNAL
FIG. 5B DISCHARGING SWITCHING SIGNAL
FIG. 5C CONTENT OF TIMER
FIG. 5D TIME-OUT SIGNAL
FIG. 5E CONTENT OF TIME-SAVE AREA 1
FIG. 5F CONTENT OF TIME-SAVE AREA 2
FIG. 5G TIME-SAVE FLAG 1
FIG. 5H TIME-SAVE FLAG 2
TA
TX
TY
A
X
Y
A-X
Z
X-Y
A-Z-(X-Y)
INDEFINITE
A-X
A-Y-(A-X)
A-Z-(X-Y)
INDEFINITE
A-Y
A-Z
SET A IN TIMER AND START
STORE A-X IN TIME-SAVE AREA 1
STORE A-Y IN TIME-SAVE AREA 2
STORE A-Z IN TIME-SAVE AREA 2
CHECK FIRST DISCHARGED PAPER SET A-X IN TIMER AND START TO STORE X-Y IN TIME-SAVE AREA 1
CHECK SECOND DISCHARGED PAPER SET X-Y IN TIMER AND START TO STORE A-Z-(X-Y) IN TIME-SAVE AREA 1
CHECK THIRD DISCHARGED PAPER SET A-Z-(X-Y) IN TIMER AND START

JAM DETECTOR

BACKGROUND OF THE INVENTION

The present invention relates to a jam detector for a transfer paper sheet.

A conventional jam detector has a configuration as shown in FIG. 1. Referring to FIG. 1, paper sheets P (to be referred to as transfer paper sheets hereinafter) stored in a cassette 5, which is disposed in a paper feed section 3 located at the right-hand side in FIG. 1, are sequentially fed out therefrom along a conveyance path 1 by means of a paper feed roller 7. The transfer paper sheet P is guided to a photosensitive drum 11 with an electrostatic latent image formed thereon through register rollers 9 which are disposed in the feed direction. After the latent image formed on the photosensitive drum 11 is transferred onto the transfer paper sheet P by chargers 13 (transfer and separation chargers), the transfer paper sheet P is discharged from a discharge section 15. A paper feed switch SW1 is arranged near the paper feed section 3 to detect the state of paper feeding. A discharging switch SW2 is arranged near the discharge section 15 to detect the state of paper discharge. The switches SW1 and SW2 are arranged mainly to detect paper jamming. In this example, after the transfer paper P is fed, the leading end of the transfer paper sheet P is aligned by the register rollers 9 and is then conveyed to the photosensitive drum 11. A predetermined time interval after the register rollers 9 start rotating, the discharging switch SW2 arranged in the discharge section 15 is checked to see if the transfer paper sheet P has been detected. If the discharging switch SW2 does not detect the transfer paper sheet P, it is determined that a jam has occurred between the register rollers 9 and the discharge section 15. Even if the leading end of the transfer paper sheet P is detected by the switches SW1 and SW2 at the proper time, when the trailing end of the transfer paper sheet P is detected by the switch SW1 but is not detected by the switch SW2 within a predetermined time interval thereafter, it is determined that a jam has occurred in the discharge switch area.

In the conventional detector of the above arrangement for detecting a jam after the predetermined conveying time of the transfer paper sheet P elapses when transfer paper sheets P are sequentially conveyed at predetermined intervals, a plurality of timers must be arranged corresponding to the number of transfer paper sheets. A complex control circuit is required for the switching and setting of timers, resulting in a high manufacturing cost, time-consuming operation and degradation of the reliability of the apparatus.

SUMMARY OF THE INVENTION

The present invention has been made to eliminate the above drawbacks and has as its object to provide a jam detector which is simple, economical and highly reliable.

According to one aspect of the present invention, there is provided a jam detector comprising: switching means for detecting a transfer paper sheet which reaches a second position from a first position thereof; timer means, having a preset value corresponding to a predetermined conveying time, for producing a time-out signal after counting a predetermined number of count pulses; comparator means, connected to said timer means and said switching means, for receiving an output signal from said switching means in response to the time-out signal from said timer means and for comparing the time-out signal and the output signal from said switching means; memory means, connected to said timer means, for storing data corresponding to the predetermined conveying time preset in said timer means; and operation controlling means, connected to said timer means and said memory means, for computing data corresponding to conveying time for a second transfer paper sheet of a plurality of transfer paper sheets to reach a current position from the first position by using the value preset in said timer means when at least a first transfer paper sheet reaches the second position under the condition where the plurality of transfer paper sheets are present along a conveyance path extending from the first position to the second position, for storing the computed data in said memory means, and for resetting the computed data stored in said memory means to said timer means so as to detect a jam of the second transfer paper sheet after the first transfer paper sheet is detected.

BRIEF DESCRIPTION OF THE DRAWINGS

Other objects and features of the present invention will be apparent from the following description taken in connection with the accompanying drawings, in which:

FIGS. 3A to 3F are timing charts for explaining the mode of operation of the jam detector shown in FIG. 2, in which FIG. 3A shows a register roller drive signal, FIG. 3B shows a discharging switch signal, FIG. 3C shows the content of the timer, FIG. 3D shows a time-out signal, FIG. 3E shows the content of the time-save area, and FIG. 3F shows a time-save flag;

FIGS. 4A to 4C are flow charts of a control program which controls the operation of the jam detector shown in FIG. 2, in which FIG. 4A shows a main routine, FIG. 4B shows a timer set routine, and FIG. 4C shows an interrupt routine; and FIGS. 5A to 5H are timing charts when three or more transfer paper sheets are continuously conveyed along the conveyance path in the jam detector shown in FIG. 2, in which FIG. 5A shows a register roller drive signal, FIG. 5B shows a discharging switch signal, FIG. 5C shows the content of the timer, FIG. 5D shows the time-out signal, FIG. 5E shows the contents of the time-save area 1, FIG. 5F shows the contents of the time-save area 2, FIG. 5G shows a time-save flag 1, and FIG. 5H shows a time-save flag 2.

DETAILED DESCRIPTION OF THE PREFERRED EMBODIMENT

Figure 1:
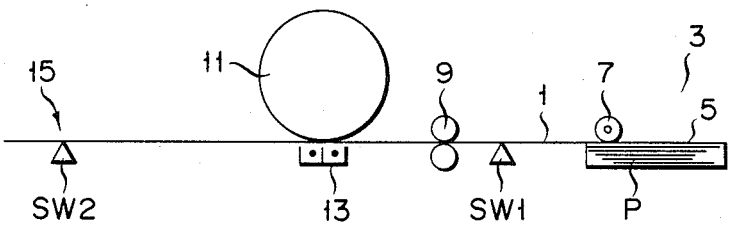
FIG. 1 (PRIOR ART)
FIG. 1 is a schematic view of a conventional jam detector.
Figure 2:
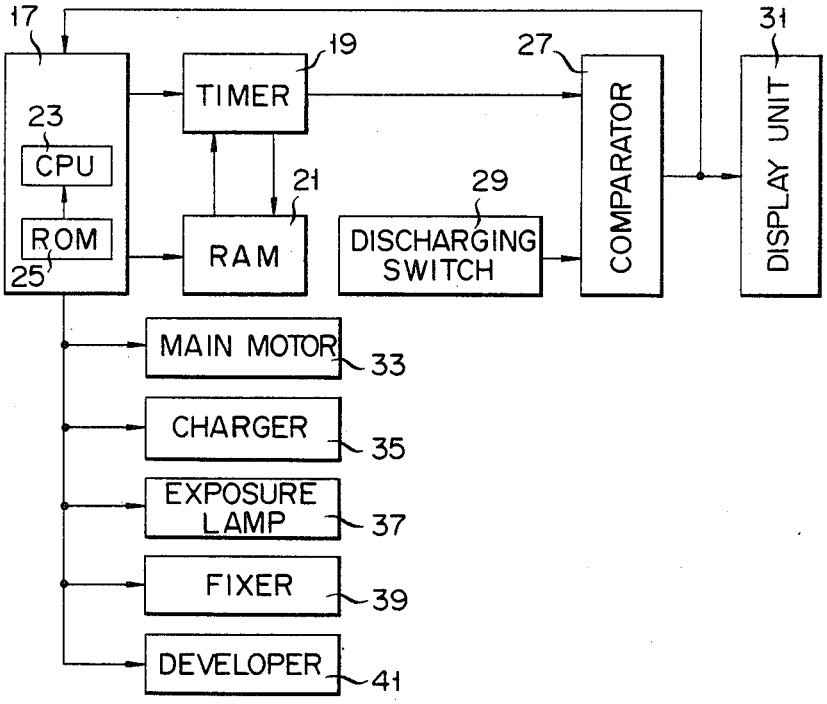
FIG. 2 is a block diagram of a jam detector according to an embodiment of the present invention.

FIG. 2 shows a jam detector according to an embodiment of the present invention. An operation control device 17 is connected to a timer 19 and a random access memory (RAM) 21. The operation control device 17 has a central processing unit (CPU) 23 and a read-only memory (ROM) 25. The output end of the timer 19 is connected to one input end of a comparator 27. The output end of a discharging switch 29 is connected to the other input end of the comparator 27. The output end of the comparator 27 is connected to the operation control device 17 and to a display unit 31. The operation control device 17 is also connected to a main motor 33, a charger 35, an exposure lamp 37, a fixer 39 and a developer 41 of the main body of the copying machine. The operation control device 17 controls the start and stop of the main motor 33, the charger 35, the exposure lamp 37, the fixer 39 and the developer 41. The operation control device 17 may comprise a 4-bit microcomputer TMP4320AP manufactured by Toshiba Corporation. The operation control device 17 computes a value corresponding to the conveying time of the transfer paper sheet and sets the value in the timer 19. The operation control device 17 then computes a value for the conveying time of the next transfer paper sheet, and stores this value as a timer reset time in the RAM 21. The timer 19 comprises a down counter which counts down the value by one in response to each count pulse from the operation control device 17. Furthermore, a value corresponding to the timer preset time stored in the RAM 21 is set in the timer 19 under the control of the operation control device 17. When the timer 19 counts a predetermined number of count pulses, it produces a time-out signal (borrow signal). The comparator 27 receives the time-out signal and a paper detection signal from the discharging switch 29 and compares them. The compared result is supplied to the display unit 31 and is fed back to the operation control device 17.

Figures 3A, 3B, 3C, 3D, 3E, 3F:
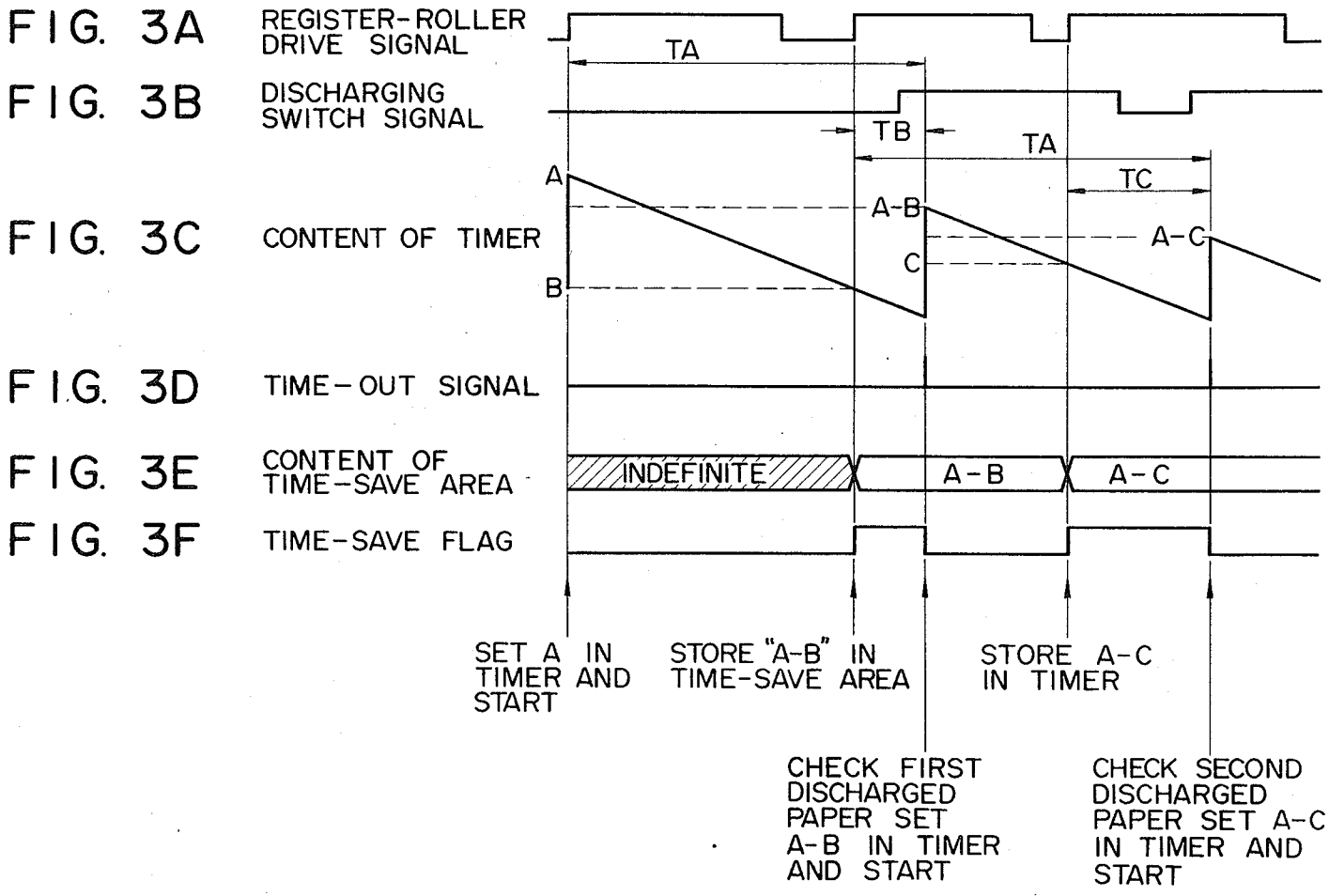

The mode of operation of the jam detector will be described with reference to the timing charts in FIGS. 3A to 3F. If the conveying speed of the transfer paper sheet is constant, regardless of the size and magnification of the transfer paper sheet, a time interval TA for the transfer paper sheet to reach the discharging switch 29 after the register rollers 9 start rotation is constant (FIGS. 3A and 3B). At the time at which the register rollers 9 are driven, the stored contents of the RAM 21 are read out by the operation control device 17 and a value A corresponding to the time interval TA is set in the timer 19, as shown in FIG. 3C, so that the timer 19 is started. Assume that the register rollers are driven to convey the next transfer paper sheet (FIG. 3A) within a predetermined time interval TB before the timer 19 produces a time-out signal, as shown in FIG. 3D. The operation control device 17 computes a value (A−B) which corresponds to a time interval (TA−TB) obtained by subtracting the time interval TA (value A) preset in the timer 19 by the predetermined time interval TB (value B). Data corresponding to the value (A−B) is stored in a time-save area of the RAM 21 (FIG. 3E). Meanwhile, the timer 19 continues to count down to detect any jam of the previous transfer paper sheet, that is, of the first transfer paper sheet. When the timer 19 produces the time-out signal, the discharging switch 29 is checked. When the input signals to the comparator 27 coincide, it is determined that the first paper sheet has been conveyed without jamming. However, if the input signals to the comparator do not coincide, an error signal is supplied from the comparator 27 to the display unit 31. A message indicating that a paper jam exists is displayed at the display unit 31. At this time, an updated value must be set in the timer 19 to detect any jam of the transfer paper sheet currently being conveyed, that is, of the second transfer paper sheet. The timer 19 starts decrementing to detect any jamming of the second transfer paper sheet when the time interval TB has elapsed after the register rollers 9 are driven. As shown in FIG. 3C, the value corresponding to the time interval (TA−TB), that is, the value (A−B) whose data is stored in the time-save area of the RAM 21, is reset in the timer 19. In this manner, the second transfer paper sheet is simply and smoothly detected by the single operation of the timer 19.

Figure 4A:
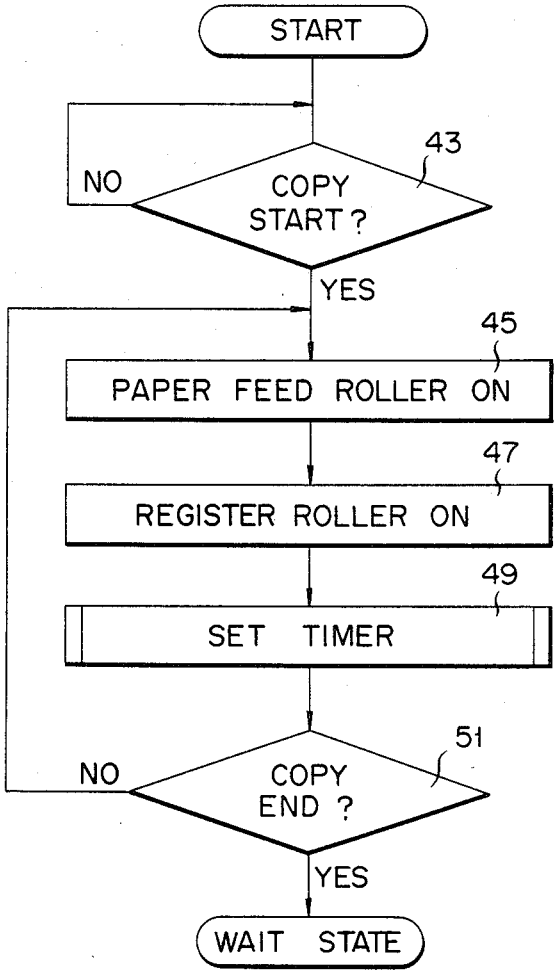

The relationship in the copying operation of the present invention between the subroutine for setting the proper value in the timer 19 for jam detection and the interrupt routine for interrupting the operation of the display unit and other units will now be described with reference to the flow charts in FIGS. 4A to 4C. FIG. 4A shows the main routine for controlling the copying operation. In step 43, it is checked whether or not copying has started, that is, whether the operator has pressed the copy button. If YES, the paper feed roller 7 is turned on in step 45. Furthermore, in step 47, the register rollers 9 are turned on. In step 49, a constant is set in the timer 19, and copying is performed. The flow advances to step 51. It is checked in step 51 whether or not the copying operation is completed. If NO, the flow returns to step 45 where the paper feed roller 7 is turned on. However, if the result is YES in step 51, the "wait" state is initiated for the next copying requirement.

Figure 4B:
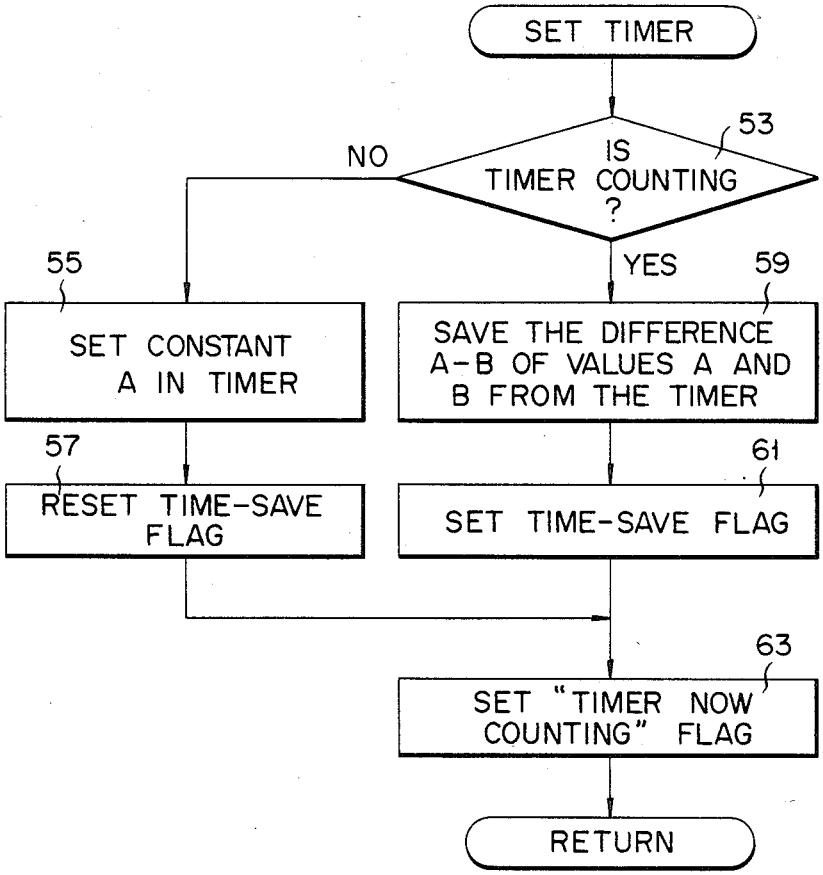

FIG. 4B shows a subroutine for setting a constant in the timer 19. In step 53, it is determined whether or not the timer 19 is counting. If YES, the difference (A−B) of the values A and B from the timer 19 is saved in the RAM 21 without setting the constant A in the timer 19, so as to detect any jam of the second transfer paper sheet. Furthermore, in step 61, a time-save flag is set in the RAM 21 to indicate the end of the data storage. The flow then advances to step 63. However, if NO in step 53, the constant A is set in the timer 19 in step 55. Furthermore, in step 57, the time-save flag is reset, and the flow advances to step 63. In step 63, a "timer now counting" flag is set in the RAM 21.

Figure 4C:
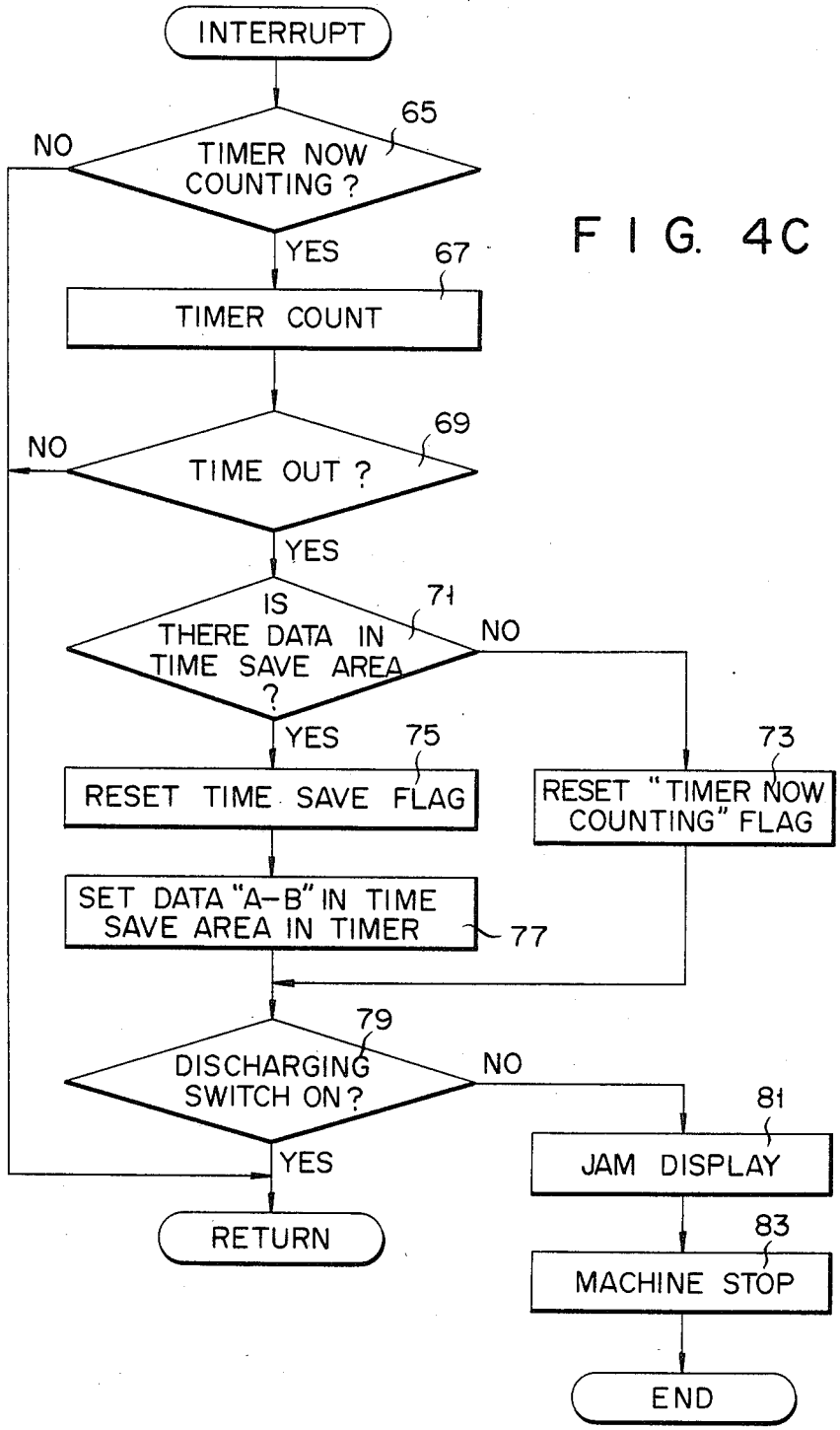

FIG. 4C shows an interrupt routine which is intermittently performed by internal interrupt. In step 65, the timer 19 is checked to determine if it is now counting down the value. If NO, the interrupt routine returns to the main routine. However, if YES in step 65, the timer 19 starts counting down the value in step 67. In step 69, it is determined whether the borrow signal is produced, that is, whether the timer 19 produces the time-out signal. If NO, the interrupt routine returns to the main routine. However, if YES, the flow advances to step 71. In step 71 the time-save area of the RAM 21 is checked to determine if data is stored therein. If NO, the "timer now counting" flag is reset during timer counting in step 73 indicating that the next transfer paper sheet is not yet being conveyed at the time when the time-out signal is produced by the timer 19. Thereafter, the flow advances to step 79. However, if YES in step 71, the time-save flag is reset in step 75, the value (A−B) is set in the timer 19 in step 77, and the flow then advances to step 79. It is determined in step 79 whether or not the discharging switch 29 is ON. If YES, it is determined that no jam has occurred and the interrupt routine is completed. However, if the result is NO in step 79, it is determined that a jam has occurred, and in step 81 a message is displayed to indicate the paper jam. In step 83, the main motor 33, the charger 35, the exposure lamp 37, the fixer 39 and the developer 41 are stopped.

In the preceding description, for illustrative convenience, a case was dealt with in which at most two transfer paper sheets are present in the conveyance path. A case will now be described with reference to the timing charts in FIGS. 5A to 5H in which three or more transfer paper sheets are continuously conveyed along the conveyance path. In this case, part of the control program must be modified, and another time-save area or areas must be added to the RAM 21.

In order to feed the second and third transfer paper sheets, respectively, within predetermined time intervals TX and TY before the timer 19 produces the time-out signal, while the first transfer paper is being fed, values or constants (A−X) and (A−Y) which are obtained by subtracting the constant A by the values X and Y, respectively are stored in a first time-save area 1 and a second time-save area 2, respectively, as shown in FIGS. 5E and 5F, when the register rollers 9 are turned on as shown in FIG. 5A. The time-save flag 1 and the time-save flag 2 respectively shown in FIGS. 5G and 5H are ON. At this time, in order to set a constant in the timer 19 to detect any jam of the second transfer paper sheet, data corresponding to the value (A−X) which is stored in the first time-save area 1 of the RAM 21 is set in the timer 19, as shown in FIG. 5C. Thereafter, a constant is set in the timer 19 to detect any jam of the third transfer paper sheet when a time interval TY+(-TA−TX) has elapsed after the register rollers 9 are driven for the third transfer paper sheet. In this case, the constant is (A−Y)−(A−X)=X−Y, as shown in FIG. 5C. In order to set the constant (X−Y) in the timer 19, a value or constant which is obtained by subtracting data stored in the first time-save area 1 from data stored in the second time-save area 2 is transferred to the first time-save area 1. Subsequently, when the fourth transfer paper sheet is fed out (in this case, the first transfer paper sheet is already discharged), a value or constant (A−Z), obtained by subtracting a value Z set in the timer 19 at the ON timing of the register rollers 9 from the constant A, is stored in the second time-save area 2, as shown in FIG. 5F. When the timer 19 produces the time-out signal which indicates completion of jam detection of the second transfer paper sheet, a value (A−Z)−(X−Y), which is obtained by subtracting data stored in the first time-save area 1 from data stored in the second time-save area 2 in the same manner as described above, is stored in the first time-save area 1, as shown in FIG. 5E. The above operation is repeated to readily detect any paper jam for each of a plurality of transfer paper sheets by a single timer.

The present invention is not limited to the particular embodiments described above. Various changes and modifications may be made within the spirit and scope of the present invention. In the above embodiments, the current value A at the time when the second transfer paper sheet is fed by the register rollers 9 is decreased by the value B corresponding to the preset time. The computed result corresponding to the value (A−B) is stored in the RAM 21. When the timer 19 produces the time-out signal, the value (A−B) is set in the timer 19. However, when the second transfer paper sheet is fed out by the register rollers 9, the current count value A may be stored in the RAM 21. When the timer produces a time-out signal, a computed result corresponding to the value (A−B) may be set in the timer. Furthermore, in the above embodiments, the timer 19 comprises a down counter. However, an up counter may be used in place of the down counter. Furthermore, the present invention is not limited to an electronic copying machine, but may be extended to an electronic printing apparatus such as a facsimile.

What we claim is:

1. A jam detector, used in a sheet transfer device, for performing jam detection of first and second transfer sheets on a conveyance path between a first position and a second position by comparing the conveying times of the first transfer sheet and the subsequent second transfer sheet with a predetermined time needed for a transfer sheet to move between the first and second positions, said detector comprising:

a single timer means which can be preset with a value corresponding to said predetermined time, said single timer means begins to count down the preset value to a given value in response to the first transfer sheet passing the first position on said conveyance path, and generates a time-out signal when the given value is reached;

memory means, responsive to the second transfer sheet passing the first position on said conveyance path subsequent to the first transfer sheet, for storing data corresponding to that count value of said timer means which is obtained when the second transfer sheet passes the first position;

detection means for detecting the first transfer sheet at the second position and generating a detection signal;

first judging means for detecting, in response to the detection signal from said detection mens, whether or not the time-out signal is generated and for judging that a paper jam has occurred when it is detected that the time-out signal is generated; and second judging means for reading the data stored in said memory means, when said first judging means determines that no paper jam has occurred, for computing a preset value for the·second transfer sheet based on the read-out data, for setting said timer means with the computed value, and for permitting said timer to count down.

2. A jam detector according to claim 5, wherein said second judging means comprises a programmable microprocessor which is connected to said timer means, said memory means and said first judging means, and which includes a central processing unit for receiving said time-out signal from said first judging means to control said timer means and said memory means, and a read-only memory device for storing a permanent program executed in said central processing unit, whereby said second judging means controls said timer means, said memory means and said first judging means and computes the value corresponding to the remaining conveying time for the next transfer sheet by subtracting the time it took said next transfer sheet to reach its current position from the first position from said predetermined time, to store said remaining conveyance time for said next transfer sheet in said memory means, and to reset said remaining conveyance time stored in said memory means to said timer means, thereby allowing jam detection of the next transfer sheet after the preceding transfer sheet is detected.

3. A jam detector according to claim 1, further comprising a display unit, connected to said first judging means, for displaying a message indicating a sheet jam when said first judging means judges that a paper jam has occurred.

4. A jam detector according to claim 1, wherein said sheet transfer device includes a main motor, a charger, an exposure lamp, a fixer and a developer, said second judging means is further connected to said main motor, said charger, said exposure lamp, said fixer and said developer to interrupt operation of said main motor, said charger, said exposure lamp, said fixer and said developer when said second judging means receives a signal from said first judging means indicating that a paper jam has occurred.

* * * * *